US007331522B2

(12) United States Patent
Sandoval et al.

(10) Patent No.: US 7,331,522 B2
(45) Date of Patent: Feb. 19, 2008

(54) VIRTUAL GATE SYSTEM

(75) Inventors: Greg Sandoval, San Diego, CA (US); Mark Kroncke, San Diego, CA (US)

(73) Assignee: Cubic Corporation, San Diego, CA (US)

( * ) Notice: Subject to any disclaimer, the term of this patent is extended or adjusted under 35 U.S.C. 154(b) by 197 days.

(21) Appl. No.: 10/913,134

(22) Filed: Aug. 6, 2004

(65) Prior Publication Data

US 2005/0092831 A1 May 5, 2005

Related U.S. Application Data

(60) Provisional application No. 60/493,120, filed on Aug. 7, 2003.

(51) Int. Cl.
*G07B 15/02* (2006.01)

(52) U.S. Cl. ..... 235/38 ; 235/382; 235/382.5

(58) Field of Classification Search ..... 235/380, 235/382, 382.5, 384
See application file for complete search history.

(56) References Cited

U.S. PATENT DOCUMENTS

| | | | | |
|---|---|---|---|---|
| 4,808,803 | A * | 2/1989 | Magier et al. | 235/382 |
| 4,816,658 | A * | 3/1989 | Khandwala et al. | 235/382 |
| 5,310,999 | A * | 5/1994 | Claus et al. | 235/384 |
| 2004/0206815 | A1 * | 10/2004 | Tarnovsky et al. | 235/382 |

FOREIGN PATENT DOCUMENTS

| | | | |
|---|---|---|---|
| EP | 1079334 | A1 | 2/2001 |
| EP | 1130549 | A2 | 9/2001 |

* cited by examiner

*Primary Examiner*—Karl D. Frech
(74) *Attorney, Agent, or Firm*—Townsend and Townsend and Crew

(57) ABSTRACT

A virtual gate provides the impression of a gated entry without a physical barrier. As such it functions as a gateway to access areas including transit Rail or, potentially, prepaid Bus services. The VG would require the interaction of the patron to present ticket media to the card reading mechanism. This action turns the gate light indicators to Green for Go or Red for No-Go, accompanied by corresponding tones to alert the patron and fare enforcement officers as to the status of validation. The ticket readers can be placed on both ends of the gate. This allows the gate to be configured for traffic flow in either direction or act as two equivalent Stand Alone Validators.

22 Claims, 14 Drawing Sheets

VIRTUAL GATE SYSTEM

CROSS-REFERENCES TO RELATED APPLICATIONS

This application claims priority to U.S. Provisional Application No. 60/493,120 filed Aug. 7, 2003 and is herein incorporated by reference for all purposes.

FIELD OF THE DISCLOSURE

This invention relates generally to gates for verifying validity of access cards utilized for access to restricted areas and, more specifically, to a virtual gate which provides the impression of a gated entry without a physical barrier, and which verifies validity of an access card and signals validity or invalidity of the access card.

BACKGROUND OF THE DISCLOSURE

Access to a station paid area can be controlled by utilization of an array of automatic fare collection (AFC) gates. These automatic fare collection gates are available in several configurations depending on specific transit agency needs, and typically read from and write to one or a combination of fare cards. Fare cards may include contact smart cards, contactless smart cards, and magnetic stripe cards. Full gates with access control typically include a physical barrier, such as a moveable bar, between two console elements. A fully gated system ensures, for all practical purposes, that fares are purchased by each patron. However, fully gated systems present disadvantages to a busy station as patrons are required to file through the gates one by one. In addition, installation and maintenance of these gates are costly.

An alternative to full gates are stand alone validators (SAV) that are used in proof-of-payment systems. A stand alone validator validates passes and tickets held by patrons, in uncontrolled areas accessible by all, but supposedly, only by patrons who have paid for the transportation or access. Transit agencies employ such techniques because the costs for a fully controlled access area are higher than they are able or willing to pay. The disadvantage of proof-of-payment systems is that, without controlled access, there is a high incidence of unpaid users of the system. The generation of any revenue is dependent upon the honesty of customers and the spot checking performed by transit agency personnel, who sometime may use a hand held verifier. Transit agencies that have installed gated systems have significantly reduced loss due to theft, human error, transfer fraud, and fare evasion. As transit ridership grows, it becomes more and more difficult to rely on policing to ensure payment within proof-of-payment systems.

BRIEF SUMMARY OF THE DISCLOSURE

In an exemplary embodiment a virtual gate (VG) is utilized to create a more customer-accessible and user-friendly fare collection system. The virtual gate may be used to replace existing stand alone validators (SAV). The virtual gate provides two key functions of educating patrons and adding security, which functions are not included in a SAV. First, the virtual gate provides transit authorities with the means to educate patrons on the concept of using gates to enter pay-access areas of an area, such as a rail or bus station. Patrons present their smart cards or magnetic tickets to the virtual gate prior to accessing the secured area and boarding the transport vehicle. The Virtual Gate also adds a level of security and a fare evasion deterrent which currently are not seen in existing systems that use SAV's. There is a clear delineation with the virtual gate line between the paid and unpaid areas of the station which deter unauthorized entry into the unpaid area. Also fare evasion officers will be able to easily identify paid and fare evading patrons as they enter the system by virtue of the gate signal lights 14,16 that indicate whether or not the patron has presented valid card media before passing through the virtual gate line. The virtual gate signal lights are easily viewed from either the paid or unpaid side of the gate line.

The virtual gate of the exemplary embodiment also lays the foundation for a fully gated system. That is, the installed virtual gates are designed to be easily upgraded or converted to full gates by the addition of paddle, leaf or tripod barriers to the gate. The arrangement of the virtual gate arrays of the exemplary embodiment provides the transit authority with the option to convert to a gated system with relative ease. The transit authority, therefore, does not lose the cost of their investment if a decision is made at a later date to transition to a gated system with barriers.

In another aspect of the disclosure, the virtual gate facilitates both check-in and a combination check-in/check-out system. In the check-in system, the fare is deducted on a flat fare basis when travel is initiated. There is one tag, or reduction of value of the access card upon entry to the system. In the combination check-in/check-out system, the fare is calculated on the distance traveled. The patron presents his or her access fare card upon entry into the system, and upon exit from the system.

In one aspect of the present disclosure, disclosed is a virtual gate that comprises a housing, and located in the housing is an access card reader, an interface board for communicating with the access reader, and a visual indicator to indicate whether a transaction has been completed. The visual indicator indicates a go situation or a no-go situation. The visual indicator is either an illumination of a green light to indicate the go situation or an illumination of a red light to indicate the no-go situation.

In another aspect of the present disclosure, disclosed is a virtual gate as described above, but which further includes a speaker connected to the interface board so that the speaker emits an audible tone. The speaker is capable of emitting a first audible tone indicating a go situation and further is capable of emitting a second audible tone indicating a no-go situation.

In another aspect of the present disclosure, disclosed is a virtual gate as disclosed above, but wherein a plurality of virtual gates may be arranged in a row to define a virtual barrier. The virtual gates may be arranged generally in a row and generally parallel in relation to each other to define a virtual barrier between a restricted area and a non-restricted area to allow traffic to flow into and out of the restricted area. The virtual gates are reversible to control traffic into and out of the restricted area.

In another aspect of the present disclosure, disclosed is a virtual gate that is upgradeable so that physical gates may be added to each virtual gate. The physical gates may include a motor located in the housing and the motor is connected to the interface board.

In another aspect of the present disclosure, a virtual gate system is disclosed wherein a plurality of virtual gates are arranged generally in a row in relation to each other to define a virtual barrier between a restricted area and a non-restricted area, and the virtual gate system further includes indicia located along the alignment of the virtual gates to define the virtual boarder. The indicia may be located on the ground and even above the virtual gates to further define the barrier.

Also disclosed herein is a method of controlling access to a restricted area, including the steps of reading an access card, checking the validity of the access card, and indicating the conclusion of the transaction by illuminating a go or no-go indicator light. The method may further include the step of emitting an audible tone to indicate the conclusion of the transaction, and further yet the audible tone may indicate a go situation or a no-go situation. The method may further include the step of allowing the patron to upgrade or increase value on the access card in a second transaction.

BRIEF DESCRIPTION OF THE DRAWINGS

The disclosure will now be described in greater detail with reference to the preferred embodiments illustrated in the accompanying drawings, in which like elements bear like reference numerals, and wherein.

DETAILED DESCRIPTION OF THE DISCLOSURE

The following detailed description utilizes a number of acronyms which relate to the present disclosure. While definitions are typically provided with the first instance of each acronym, for convenience, Table 1 below provides a list of the acronyms and abbreviations and their respective definitions.

| ACRONYM | DEFINITION |
|---|---|
| ADA | American Disabilities Act |
| AFC | Automatic Fare Collection |
| CSC | Contactless Smart Card |
| LCD | Liquid Crystal Display |
| LAN | Local Area Network |
| VG | Virtual Gate |
| SAV | Stand Alone Validator |
| SBC | Single Board Computer |
| TVM | Ticket Vending Machine |

Figure 1:
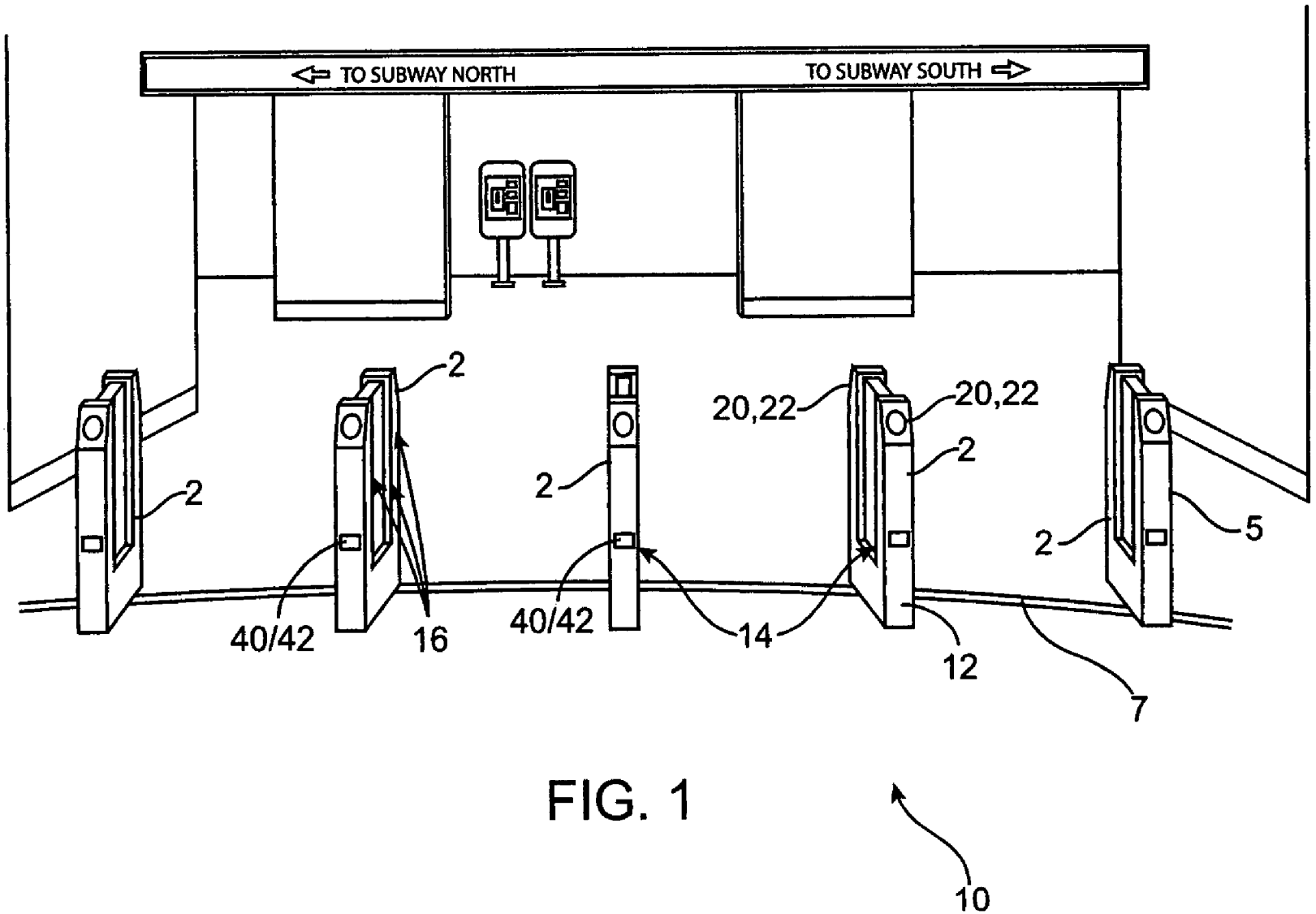
FIG. 1 illustrates a virtual gate arrangement of an exemplary embodiment of the disclosure.
Figure 6:
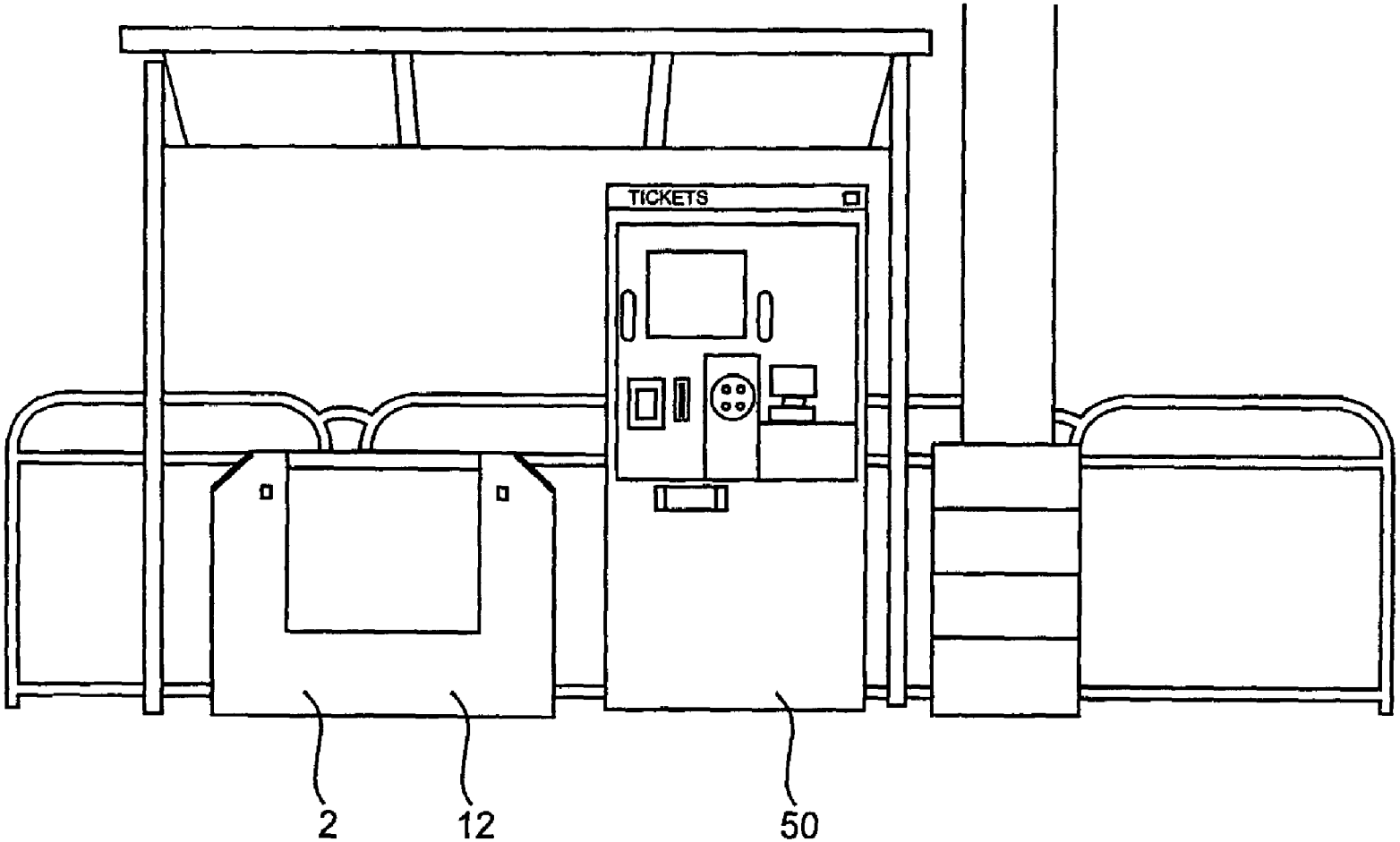
FIG. 6 illustrates a virtual gate positioned adjacent the entrance/exit of the transit platform.

FIG. 1 illustrates a virtual gate system 10 with an arrangement of single virtual gates to comprise a barrier for entrance to and exit from a restricted area. FIG. 1 illustrates a virtual gate system 10 utilized in a transit system application. A side view of a single virtual gate 2 is shown in FIG. 6. Virtual gates of the preferred embodiment utilize service-proven components and are packaged in a slim-line cabinet 12 that provides a low profile yet pleasing and contemporary appearance. The virtual gate 2 contains modules that are interchangeable with those utilized in existing gates of a particular application such as a transit station, bus depot, sports venue, or any other restricted area application. The modules may include contactless smart card readers, contact card readers, magnetic stripe readers, computer control boards, alarms, and power supplies to provide the functionality required, all of which are contained in a housing 5. The virtual gates may be aligned in a row, wherein the virtual gates are generally parallel in relation to each other to resemble a gated system, which allows or denies access to and from a restricted area. In addition, as shown in FIG. 1, indicia 7 helps to delineate the barrier between the non-restricted and the restricted areas.

Figure 8:
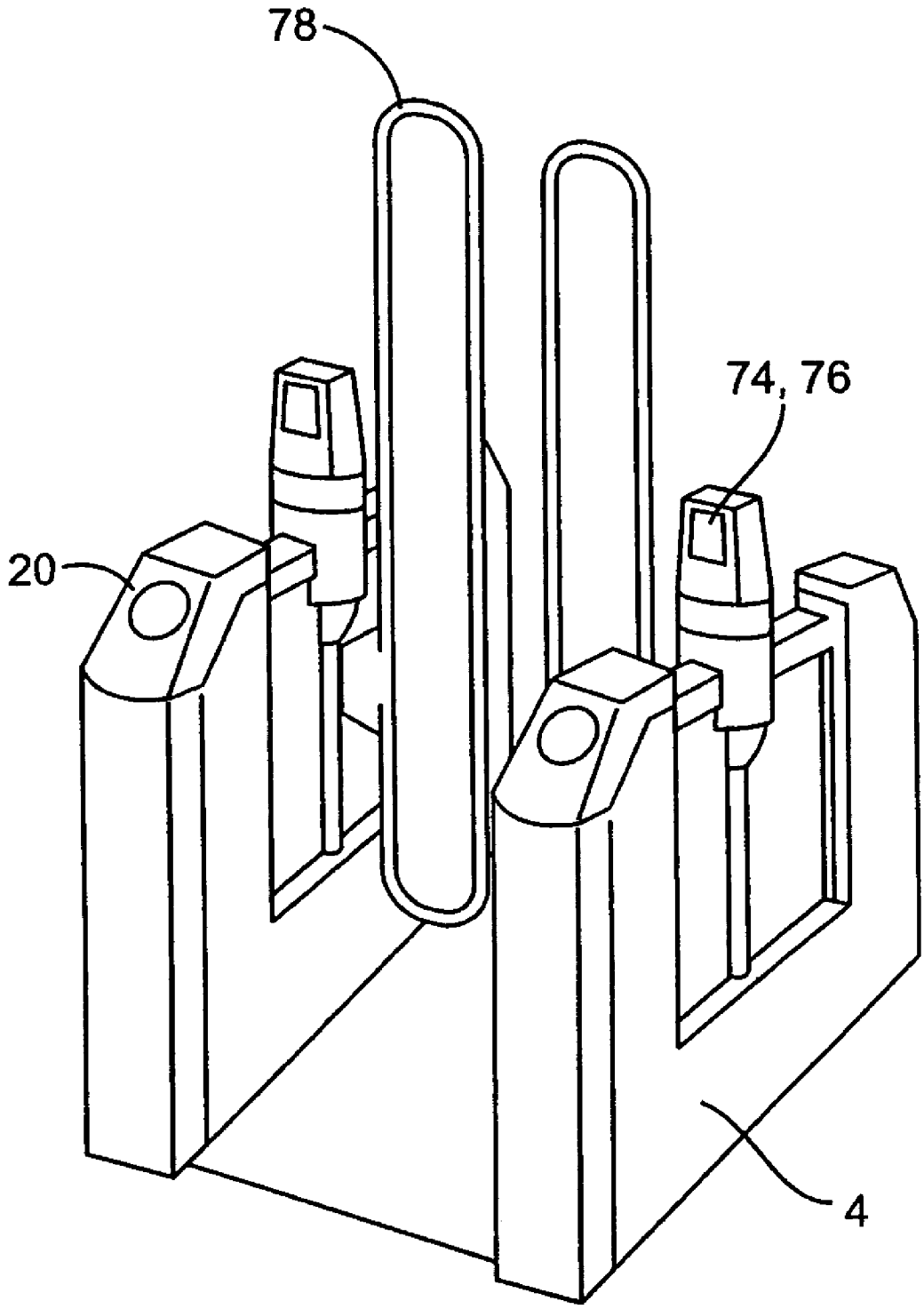
FIG. 8 illustrates yet another alternate embodiment of the virtual gate with optional paddles.
Figure 10:
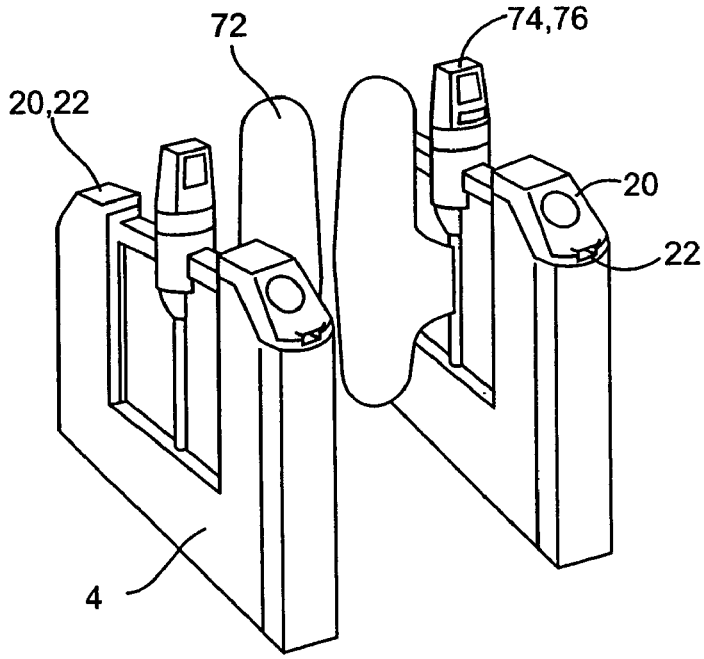
FIG. 10 is a perspective view of a virtual gate having paddles, a card reader and a programmable passenger display.

The cost to install the virtual gate 2 is similar to the price of installing a stand alone validator since both devices must be coupled to a transit area controller and/or a transit central computer. As shown in FIG. 1, virtual gate 2 provides the impression of a gated entry without a physical barrier. As such it functions as a gateway to access restricted areas, such as rail, prepaid bus services, or any other venue which requires paid or restricted access. The virtual gate 2 requires the interaction of the patron to present an access card (not shown) to the access card reader 20. FIGS. 8 and 10, which illustrate alternate embodiments of the invention, illustrate access card readers 20, 22 that may be included in the virtual gate. A contactless card reader includes a card target 20. A magnetic stripe reader or contact reader 22 requires an entry/exit bezel on the virtual gate 2.

Referring back to FIG. 1, when a patron presents a valid access card to the virtual gate 2, gate light indicators 14, 16 are illuminated to the color or shade of green to indicate to the patron that it is clear for the patron to proceed forward beyond the virtual gate 2 and into the restricted area. In contrast, the light indicator is illuminated to the color or shade of red to indicate to the patron to stop, remain stopped, and not to proceed beyond the virtual gate 2 and into the restricted area. In one embodiment, the light indicators are accompanied by corresponding tones to alert the patron as to the status of validation. As shown in FIGS. 1 and 10, the access card readers 20, 22 can be placed on both ends of the virtual gate 2. This allows the gate 2 to be configured for traffic flow in either direction, or to act as two equivalent stand alone validators. The audio system of the virtual gate 2 of this embodiment consists of a speaker mounted inside the gate 2 to provide tones to indicate the results of the access card action that just took place when the patron presented the access card.

Figure 9:
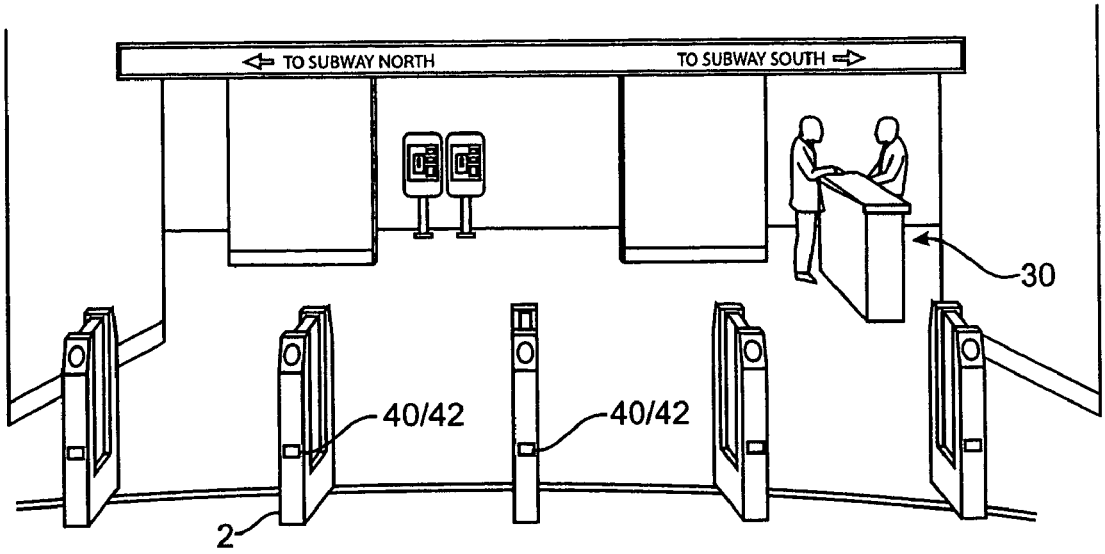
FIG. 9 illustrates virtual gates and a security gate for entrance into a restricted area.

As shown in FIG. 1, the light and audio indicators 14 on the front and rear of the virtual gate 2, as well as the light indicators 16 located in a vertical orientation on the angled interior portion of each end pillar, signal either a successful access card transaction or an unsuccessful transaction. The indicators 14, 16 are off when the gate is not being used by the patron with an access card. When a card is presented, these indicators 14, 16 signal the results of the validation with either a shade of green, meant to indicate "Go," or a shade of red to indicate "No-Go." Since these lights 14, 16 are on both ends of the virtual gate 2, the validation results can be seen equally well from either side of the gate 2. This allows a revenue enforcement officer 30, as shown in FIG. 9, to easily monitor traffic flow through the gates 2 in either direction regardless of which side of the gates 2 the officer 30 may be located.

Figure 12:
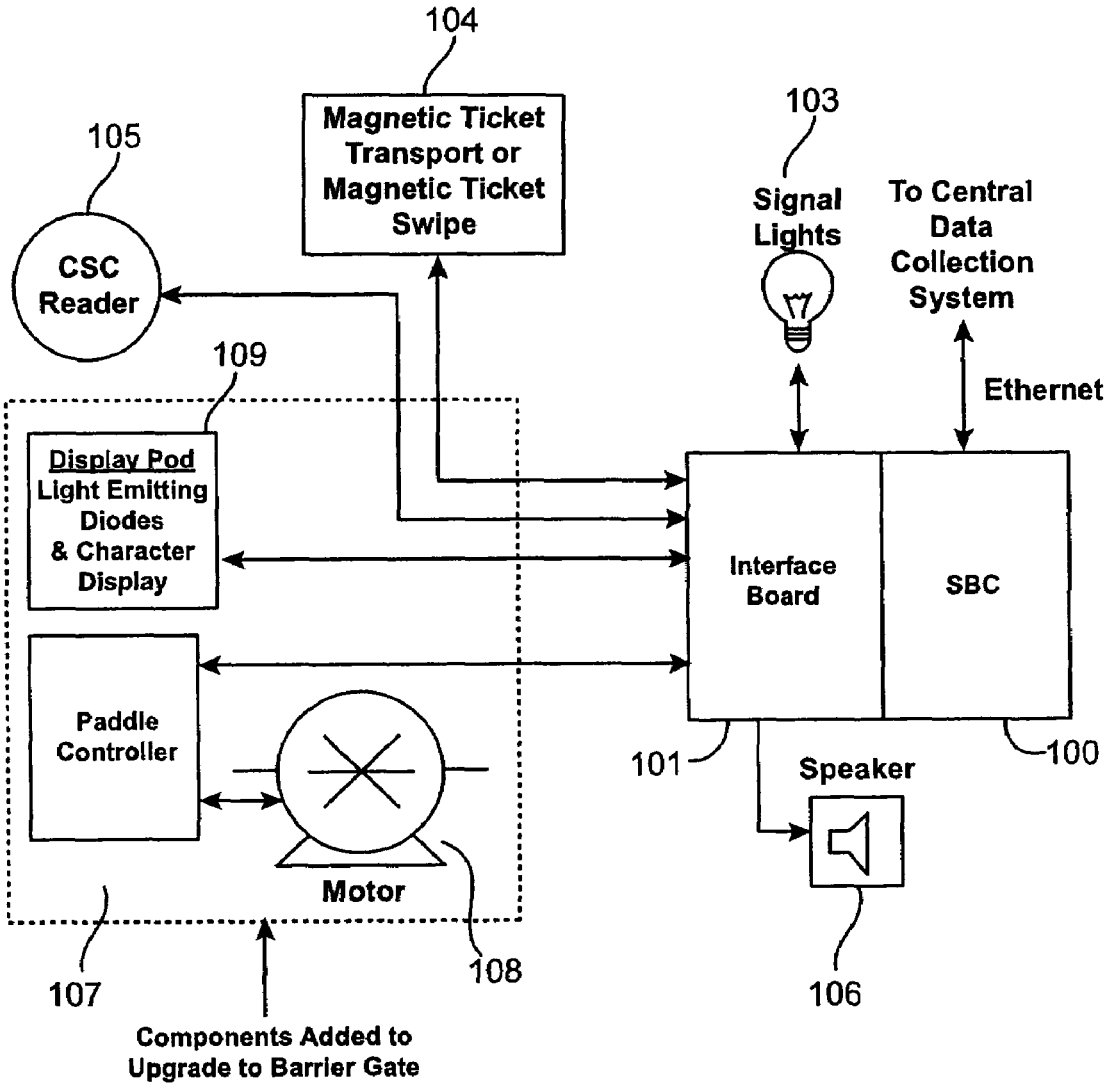
FIG. 12 is an internal block diagram of an embodiment of the disclosure showing optional components for upgrade to a barrier gate.

FIG. 12 illustrates the internal components of the virtual gate. The SBC 100 is programmed with the application software that controls the gate. Interface board 101 connects the SBC to the gate peripherals, which include: signal lights, card readers, speaker, and optional barrier gate components. The red and green signal lights 103 indicate the validity of the card transaction. The gate can be equipped with either magnetic 104 or CSC 105 ticket readers or both. These readers both read and write back to the cards to validate the tickets that are processed. The speaker 106 sounds a minimum of two tones of different pitches to signal the validity or invalidity of the transaction. To upgrade the virtual gate to a barrier gate, the paddle controller 107 and motor 108 are added to the gate. The display pod 109 that gives the patron additional card transaction information via an LCD character display is also added to the barrier gate configuration, such as 74, 76 in FIG. 8.

Figure 14:
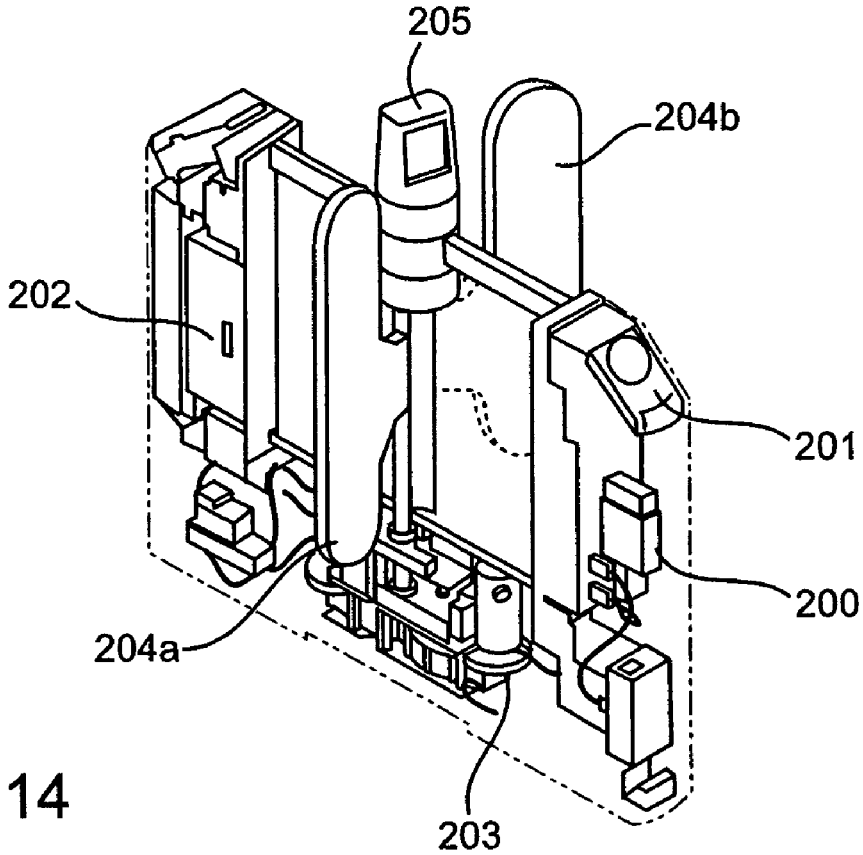
FIG. 14 is a cut away diagram of an embodiment of the disclosure showing the components of the virtual gate when the virtual gate is upgraded with a barrier.
Figure 13:
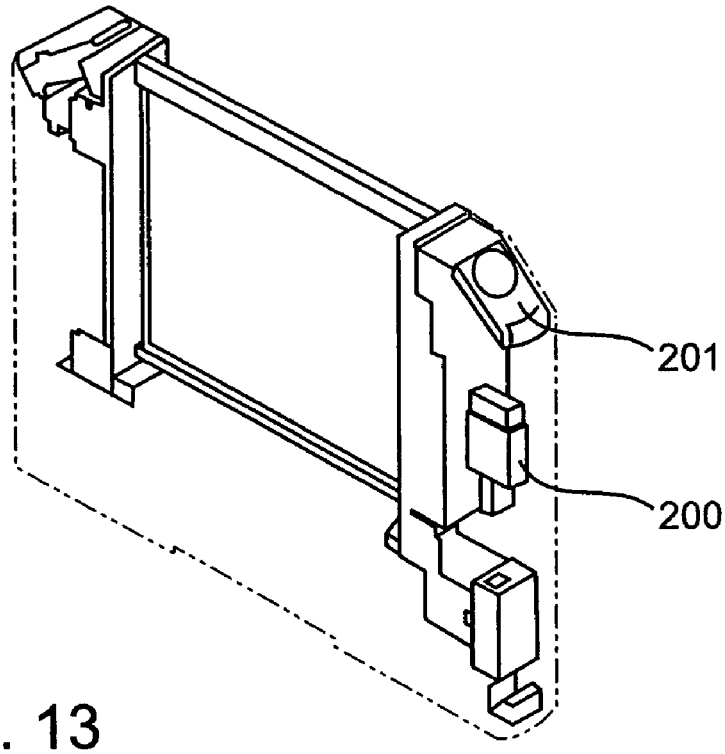
FIG. 13 is a cut away diagram of an embodiment of the disclosure showing the components of the virtual gate.

FIGS. 13 and 14 illustrate the physical configuration of the virtual gate (FIG. 13) and the barrier gate upgrade (FIG. 14). Both gates use a common SBC 200, a card reader 201, and a speaker 106. When the barrier gate is upgraded, as shown in FIG. 14, the paddle controller 202, a motor 203, and opposing paddles 204*a* and 204*b*, including a display pod 205, are added to the virtual gate so that the transit authority may easily upgrade a virtual gate system to a barrier gate system.

The green indicator 40 signals acceptance of the patron's access card and deduction of the proper fare. It provides immediate feedback and provides for quick and easy access to speed the patron through the virtual gate. The red indicator 42 signals that an access card did not register correctly. This could be that the card was "Hot Listed", or that the card is damaged and cannot be read, or that there are insufficient funds on the card for the ride, or the pass stored on the card is expired, or other reasons why the transaction could not be completed. In any of these cases, the patron is required to visit the facilities provided by the transit authority to resolve such problems.

Figure 15:
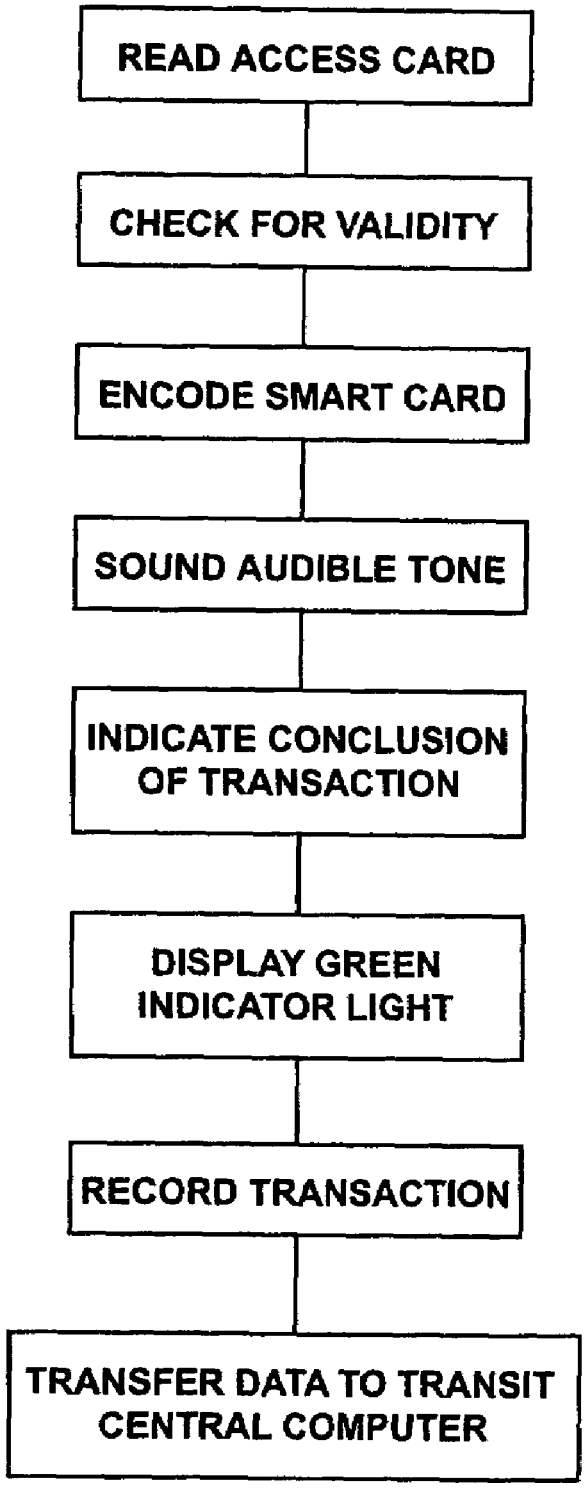
FIG. 15 illustrates a process of operation of the virtual gate of the present disclosure if the access card is accepted.
Figure 16:
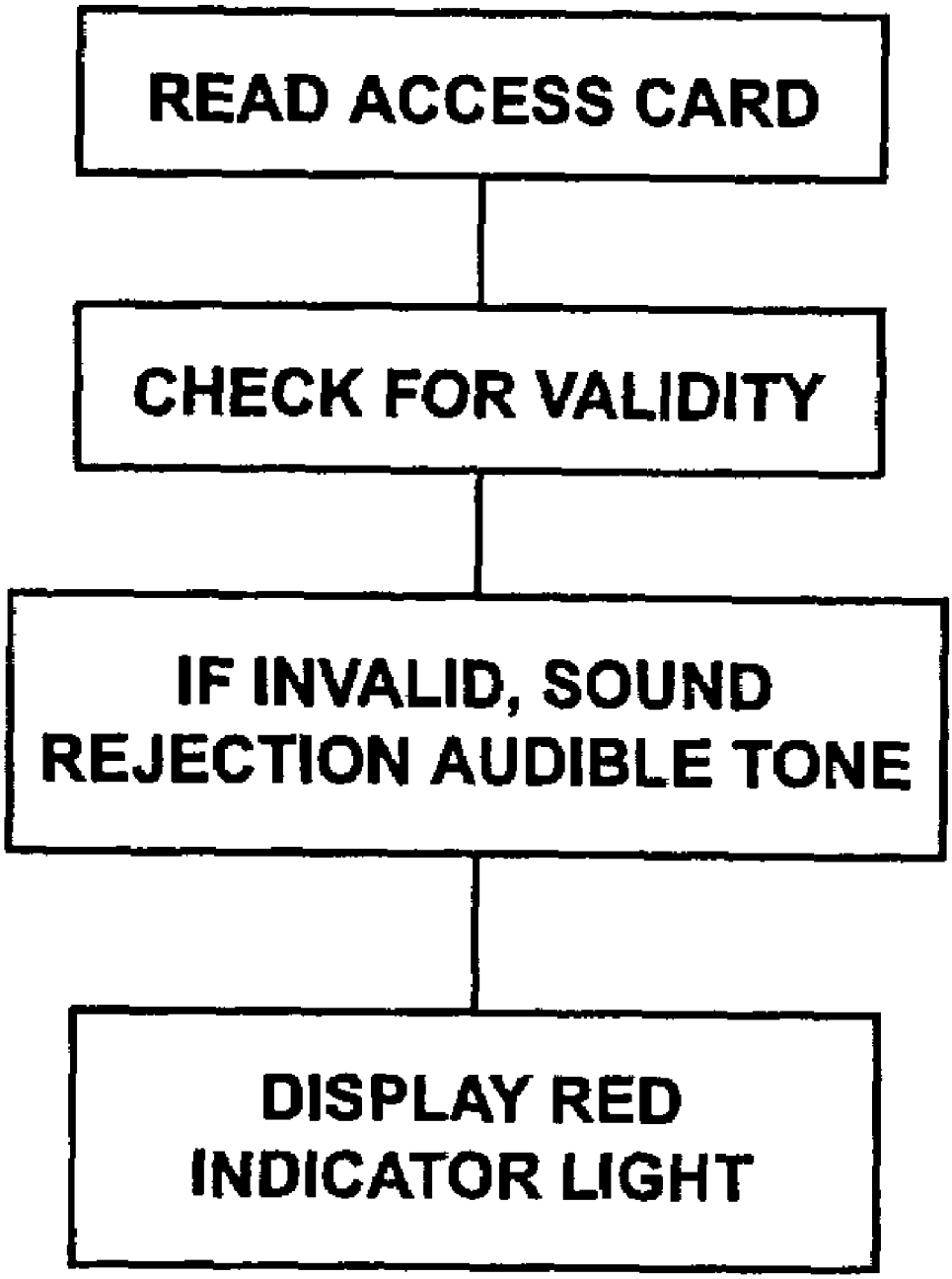
FIG. 16 illustrates a typical process of operation of the virtual gate of the present disclosure when the access card is rejected.

As shown in FIG. 15, a typical sequence of events utilizing virtual gates 2 is described below for check-in systems, or for check-in/check out systems. In a check-in only system, upon entry, the access card, or a smart card, is read and checked for validity in a first step. The smart card is encoded with the new purchase. An audible tone is sounded from the virtual gate 2 indicating conclusion of a valid transaction. The gate 2 displays a green indicator light 40. The transaction is recorded and the data is transferred via a LAN 64 from multiple transit stations, such as station 1 and station 2 shown in FIG. 2. The data is transferred to the transit central computer 62, which is connected to a central data collection system 60, which is used for collecting all of the data from the multiple transit station locations. Optionally, the data may be transferred directly from the stations via a LAN or other connection, or from the transit central computer 62 or central data collection system 60 to a laptop or other portable electronic device 66. It will be appreciated that any electronic connection may be utilized to transfer data from the stations to the storage devices, and the use of a LAN in this description is exemplary only. Failure of a smart card to be read by a gate results in a red indicator light 42 and an audio tone prompting the patron to take the appropriate action to resolve the problem, such as to add more value to the card or exchange a non-readable card by visiting a ticket vending machine 50 or a customer service booth. The rejection sequence is illustrated in FIG. 16.

In a check-in/check-out system, upon exit, the patron has the option to present a smart card to the gate 2 to upgrade or purchase travel as shown in FIGS. 13 and 14, in a check-in/check out system, the virtual gate or the barrier gate has redundant card reader writers so that the patron may add value to the access card when exiting the gate. In a first step the smart card is read and checked for validity by the reader 20, 22 of the virtual gate 2. The smart card is encoded. An audible tone is sounded indicating conclusion of a valid transaction. The gate displays a green indicator light 40. The fare is actually deducted from the card upon exiting from the gate area. The transaction is recorded and the data is transferred to the central computer 62.

The dimensions of a virtual gate console 2 of one embodiment is approximately 51.2 inches in length, approximately 6.1 inches in width and approximately 41 inches in height. However, virtual gates 2 may be any dimension as required by a particular application. Aisle width, that is, the spacing between the virtual gates 2, is established according to requirements of specific applications, and will be dependent upon, among other things, the available floor space and typical patron traffic into and out of the restricted area. The hardware utilized within the virtual gate 2 of the present disclosure is field-replaceable ensuring that there is minimal downtime if any components, or the entire gate needs to be replaced. In addition, the virtual gate of the present disclosure is designed to withstand the environmental operating conditions encountered in transit environments.

Figure 2:
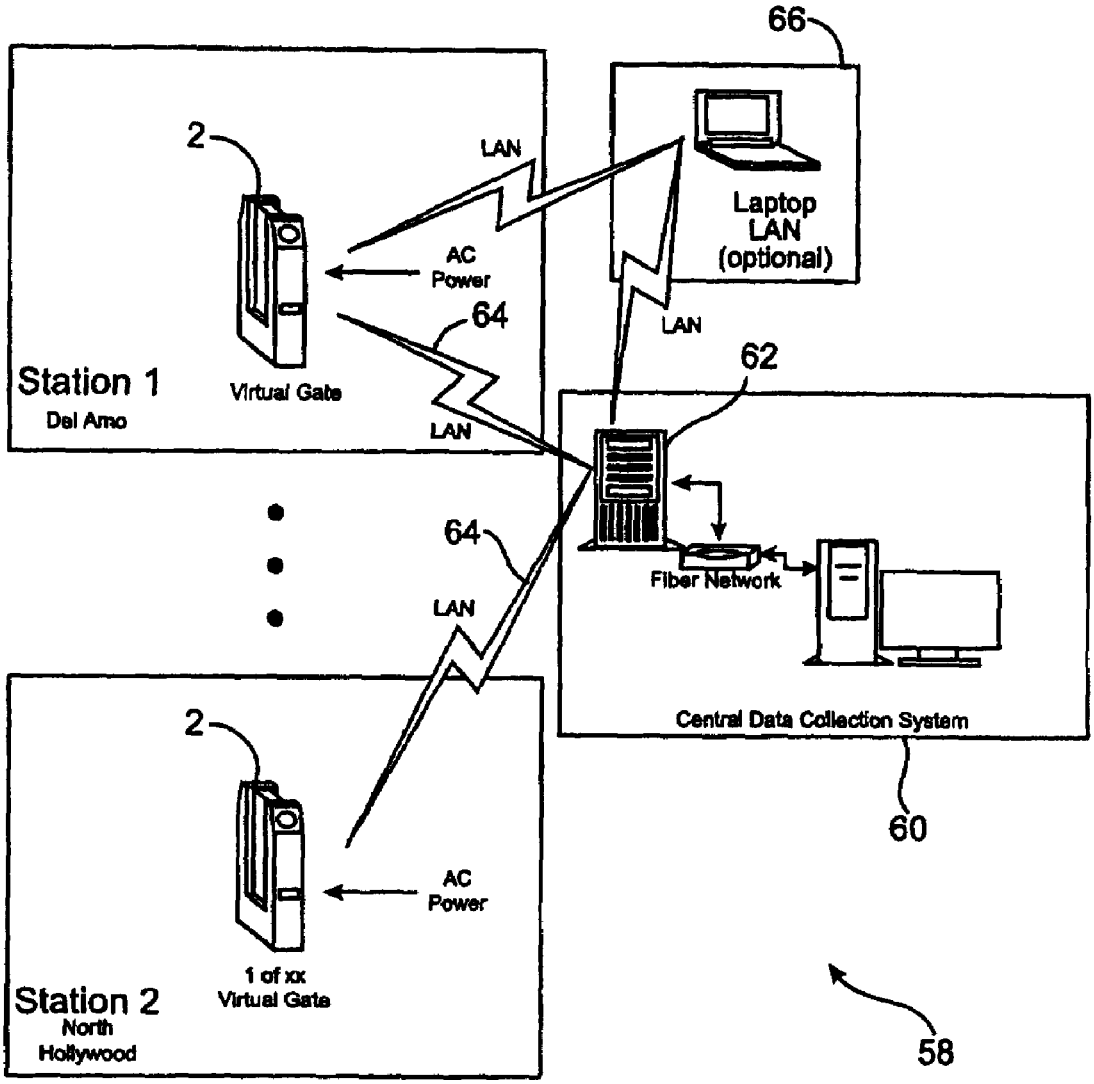
FIG. 2 is a block diagram of a virtual gate interface diagram.

Installation of a virtual gate 2 of the present disclosure allows for an installation of power cables to a power source, such as 230V or 110V, and installation of station cables. As shown in FIG. 2, the virtual gates 2 are connected to a network 64. The virtual gate 2 accepts downloads from the central computer 62 of new tables, hotlists, autoloads, and software updates. The data collected from the access cards is recorded at the virtual gate 2 and sent to the central computer 62 at specified times. The central computer 62 utilizes the data to compile reports on transaction and event records.

In one embodiment of the disclosure, Ethernet 10BaseT or 10BaseF are routed from the Central Data Collections System 60 to the Virtual Gate for data exchange. Transaction and event records are sent to the CDCS 60 from the Virtual Gate through a routing device 62. Configuration parameters and fare tables are sent to the Virtual Gate from the CDCS 60. In one embodiment, configuration parameters and fare tables are sent to the Virtual Gate from the CDCS 60 to a designated ticket vending machine 50 (TVM) in each transit station. The TVM includes an 8-port Ethernet, which distributes 10BaseT to each virtual gate 2 in the station in, e.g., a star configuration. Once routed into a virtual gate 2, the Ethernet connection is made at a single board computer (SBC),such as a main processor, of the virtual gate 2. In one embodiment, the virtual gate 2 communicates with the central data collection system 60, illustrated in FIG. 2, through the same local area network 62 that is utilized by the ticket vending machines.

The virtual gate 2 operates on an open architecture platform, which supports multiple applications, and can be configured to process smart cards as well as magnetic ticket media. The use of contactless smart card technology results in relatively low maintenance costs with no expenditure for coin/cash vault collection and processing. Continuing with FIG. 2, data is transmitted from the virtual gate 2 to the CDCS 60 almost continuously in one embodiment of the disclosure. The virtual gate 2 includes an ethernet port for attaching a portable laptop 66 to the virtual gate for manual exchange of data, if necessary or desired. Data from the gate 2 can be transferred to the laptop as well. Thus, data can be obtained from the virtual gate in case of communication failures or other failures.

The software for the virtual gate 2 of one embodiment includes a host software application to satisfy operational requirements of particular transit systems. The host application runs on, by way of example, a SBC, which provides the user interface, virtual gate transaction processing, and communications control. The host application may utilize Multi-threaded application support, TCP/IP and serial communications drivers, and Win32 API. A layer of software objects developed as extensions to the operating systems support inter-process communications, file management, digital input and output, event logging, and alarm monitoring. Virtual gate software may also provide maintenance reporting and control by monitoring the virtual gate 2 for error conditions, by signaling errors, such as intrusions, and by turning the gate out of service if necessary or desired.

Continuing with FIG. 2, the virtual gate system 58 is flexible and designed to allow for expansion of the system and of the equipment in the future. Additionally, the system 58 is configurable for different numbers of virtual gates 2. The system 58 is designed for ease of installation and removal, and each unit, such as each virtual gate 2, is essentially an independent part of the system 58. In this way, additional units can be added or deleted within the architecture with ease. An additional amount of virtual gates 2 can be added to accommodate increased ridership or to increase passenger convenience for upgrading and purchasing fare media. The virtual gates 2 are independent self-contained units and can be integrated with the existing suite of equipment and the existing communications network.

Figure 3:
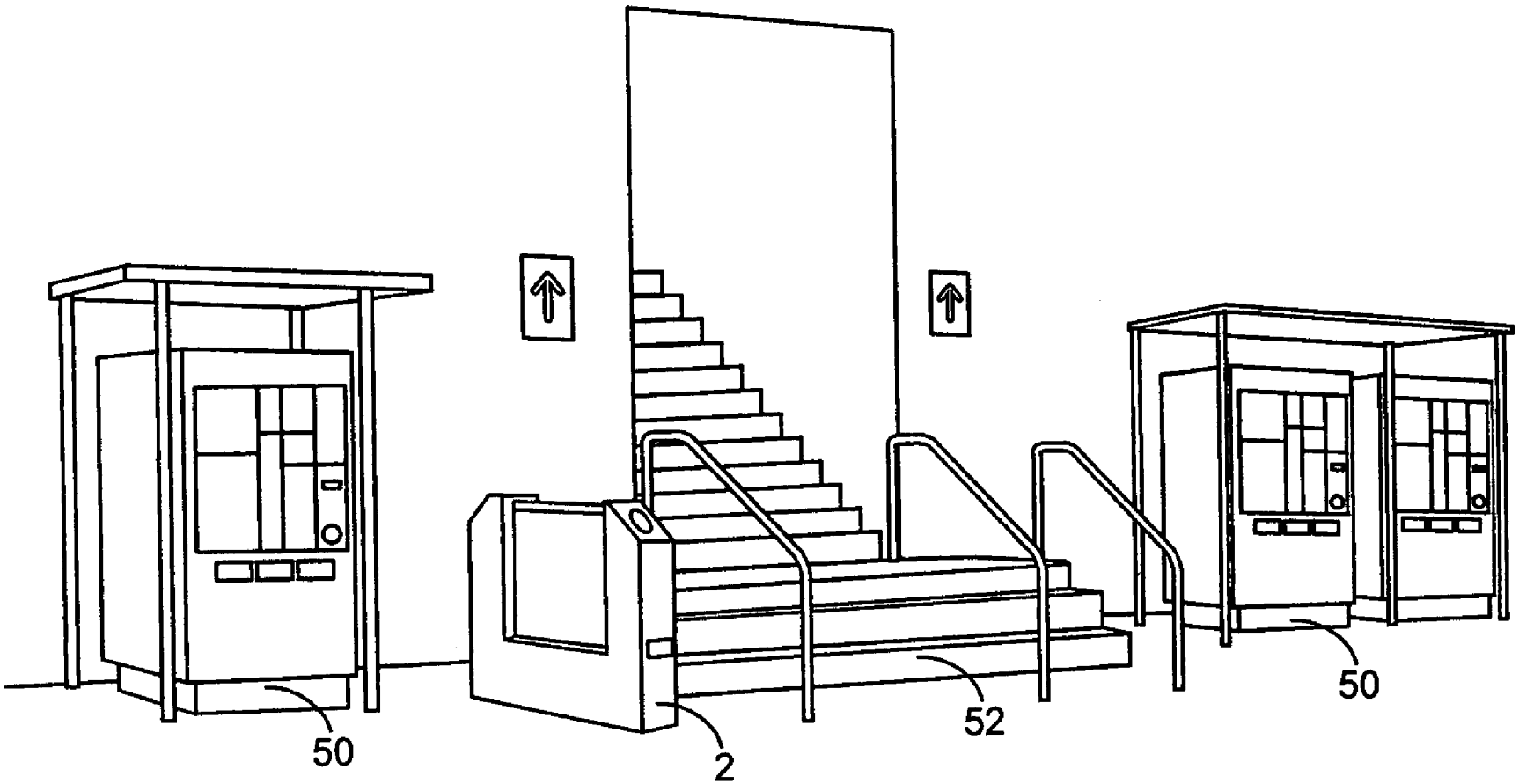
FIG. 3 illustrates a virtual gate positioned adjacent a stairwell.

The location of the virtual gates 2 is dependant on the most convenient patron access prior to boarding or departing the rail or potential bus service. The use of the virtual gate 2 at various locations is illustrated in FIG. 3 through FIG. 6. FIG. 3 illustrates a virtual gate 2 located near ticket vending machines 50 and a stairway 52 to a platform for patron access. Each such access area of the preferred embodiment includes a virtual gate for entering and leaving the platform. This allows the traveling patron to access the ticketing system quickly to upgrade or purchase additional rides on the rail system. In the alternative to the configuration shown in FIG. 3, a virtual gate 2 may be located at each side of the stairwell 52.

Figure 4:
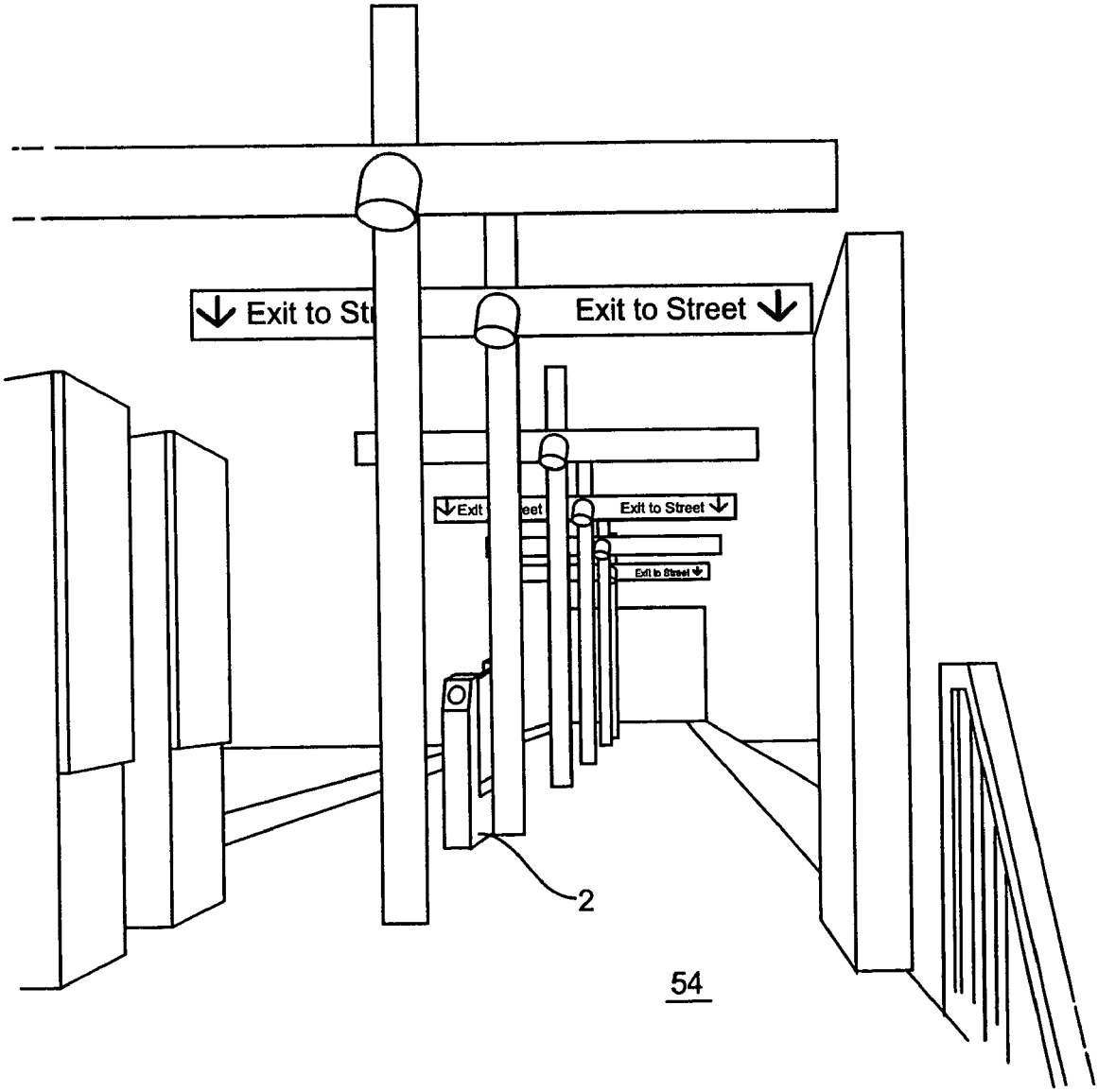
FIG. 4 illustrates a virtual gate positioned in a center area of a transit platform.
Figure 5:
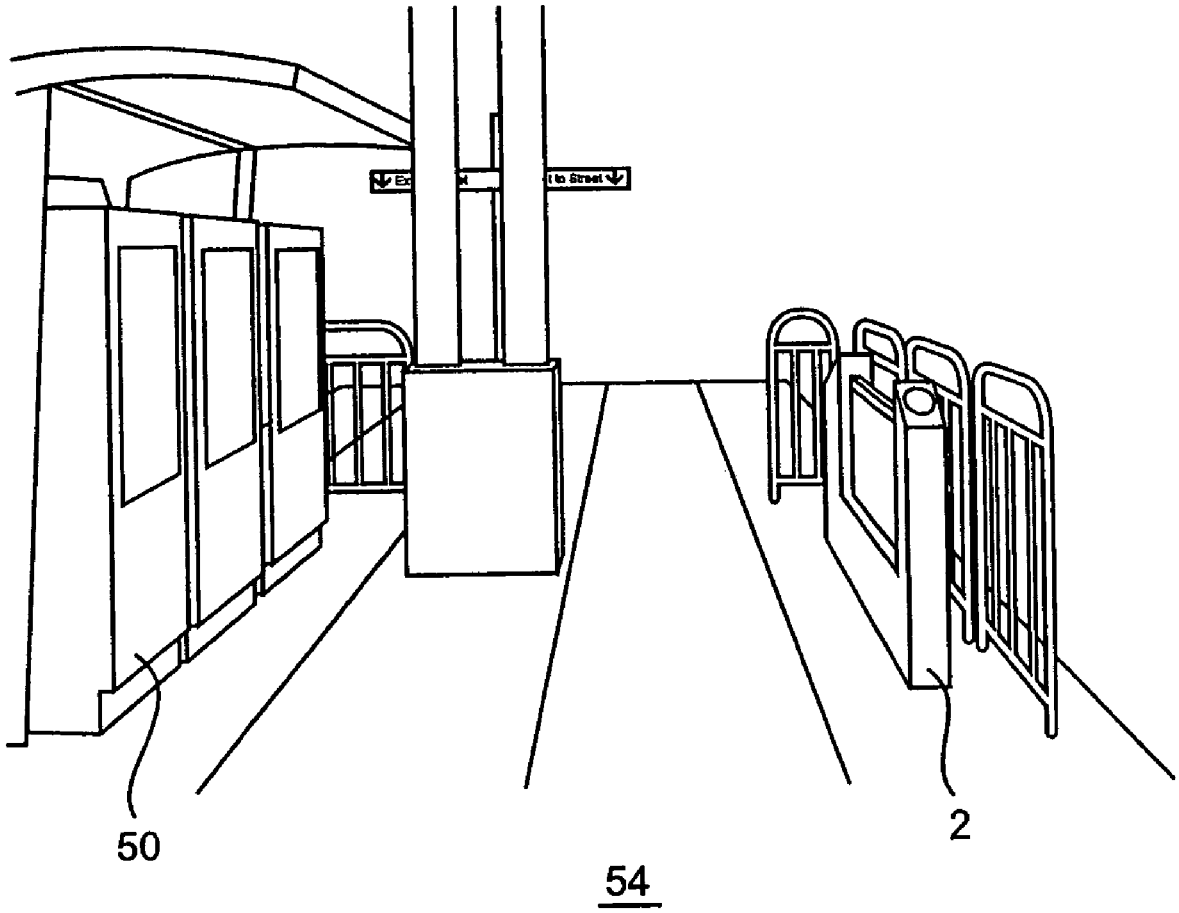
FIG. 5 illustrates a virtual gate positioned on a transit platform and near ticket vending machines.

FIG. 4 illustrates a virtual gate 2 located in the center area on a platform 54 for patron access. FIG. 5 illustrates a station that has a virtual gate 2 located across from ticket vending machines 50 near the train access on the platform 54. FIG. 6 illustrates another placement of a virtual gate located near a ticket vending machine 50 on a platform for patron access. Each platform 54 of a preferred embodiment of the system 58 includes a virtual gate 2 for entering and leaving the platform 54. This allows the traveling patron to access the ticketing system quickly to upgrade or purchase additional rides on the rail system. In the alternative, a virtual gates may be arranged so as to have a gate on each side of the path of travel of the patrons. In one example, as shown in FIG. 5, a virtual gate 2 will be installed as shown in FIG. 5, and an additional virtual gate 2 would be located adjacent to or near the ticket vending machine 50 so as to provide a virtual gate system between the two virtual gates.

Transit agencies that have installed gate systems have significantly reduced loss due to theft, human error, transfer fraud, and fare evasion. For example, London train operating companies have recognized a significant increase in revenues with the installation of gates. The automatic fare collection systems in many cities include gates as an essential component of reducing fare evasion. As transit ridership grows, it becomes more and more difficult to rely on policing to ensure payment within proof-of payment systems.

Figure 7:
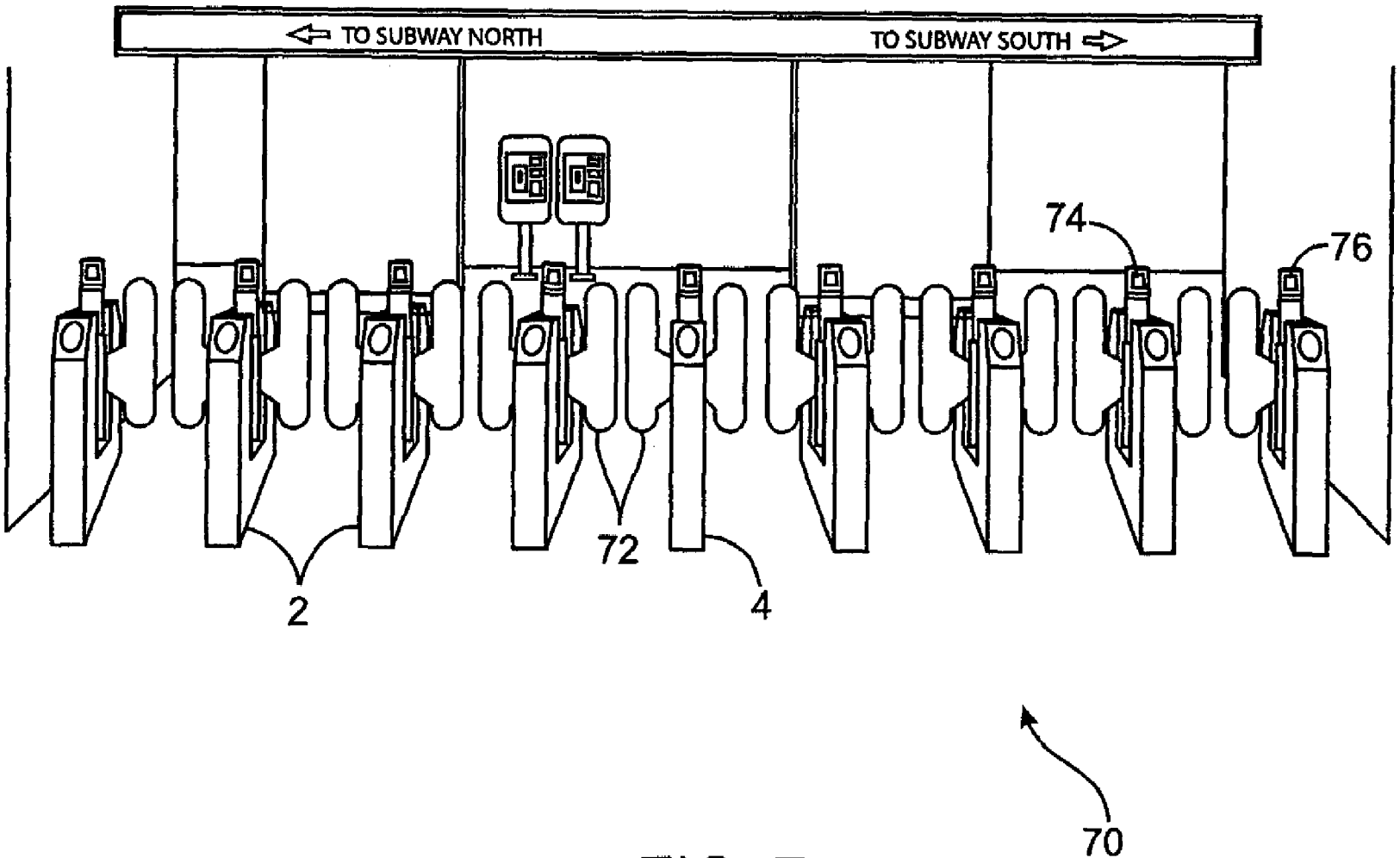
FIG. 7 illustrates the virtual gate in an alternative embodiment with optional paddles.

As shown in FIG. 7, the virtual gates 4 can be upgraded to a fully functional gating system 70 with access arms 72 to open when an access card transaction is validated and when the green indicator 74 is illuminated. In the alternative, if the transaction is not complete for a variety of reasons, the access arm 72 will remain closed and a red indicator 76 would be illuminated. This changes the gate 4 to a physical barrier for the added security that may be needed in areas characterized by frequent violators and lost revenue. These automatic fare collection gates 70 are available in several configurations depending on each specific transit agency needs. Other types of gate variations include paddle barrier, tripod barrier, bi-parting leaves barrier, swipe magnetic readers versus magnetic ticket transports, reversible gates or any number of gates or barriers that could be utilized. The paddle gates 4 can be configured with two-way entry and exit reversible fare gates, paddle gates, leaf gates, and turnstiles, as well as American Disabilities Act compliant gates 78 as shown in FIG. 8.

FIG. 10 illustrates a typical paddle gate 4 which is an upgrade to the virtual gate platform. It offers fast throughput, high safety compliance. The gate is short and compact with high intensity walkway indication 74, 76. The gate is smart card enabled 20, 22, and incorporates the latest technology to process contactless smart cards to ISO standards. The Cubic Tri-reader 20 allows reading/writing of Type A and B cards, Go cards, and other special protocol cards giving complete flexibility to the operator on card choice. The gate 4 is available with or without conventional magnetic ticket processing facilities to bridge the gap between existing ticketing systems and introduction of smart cards. The walkway between the virtual gate is sufficiently wide for wheelchair access, bicycles, luggage, or other applications. By utilizing smart cards, the additional feature of ticket on departure may be implemented at point of entry into the system with online connection to the service provider's central system. The gate 4 can easily be installed without station excavation for cable runs.

Figure 11:
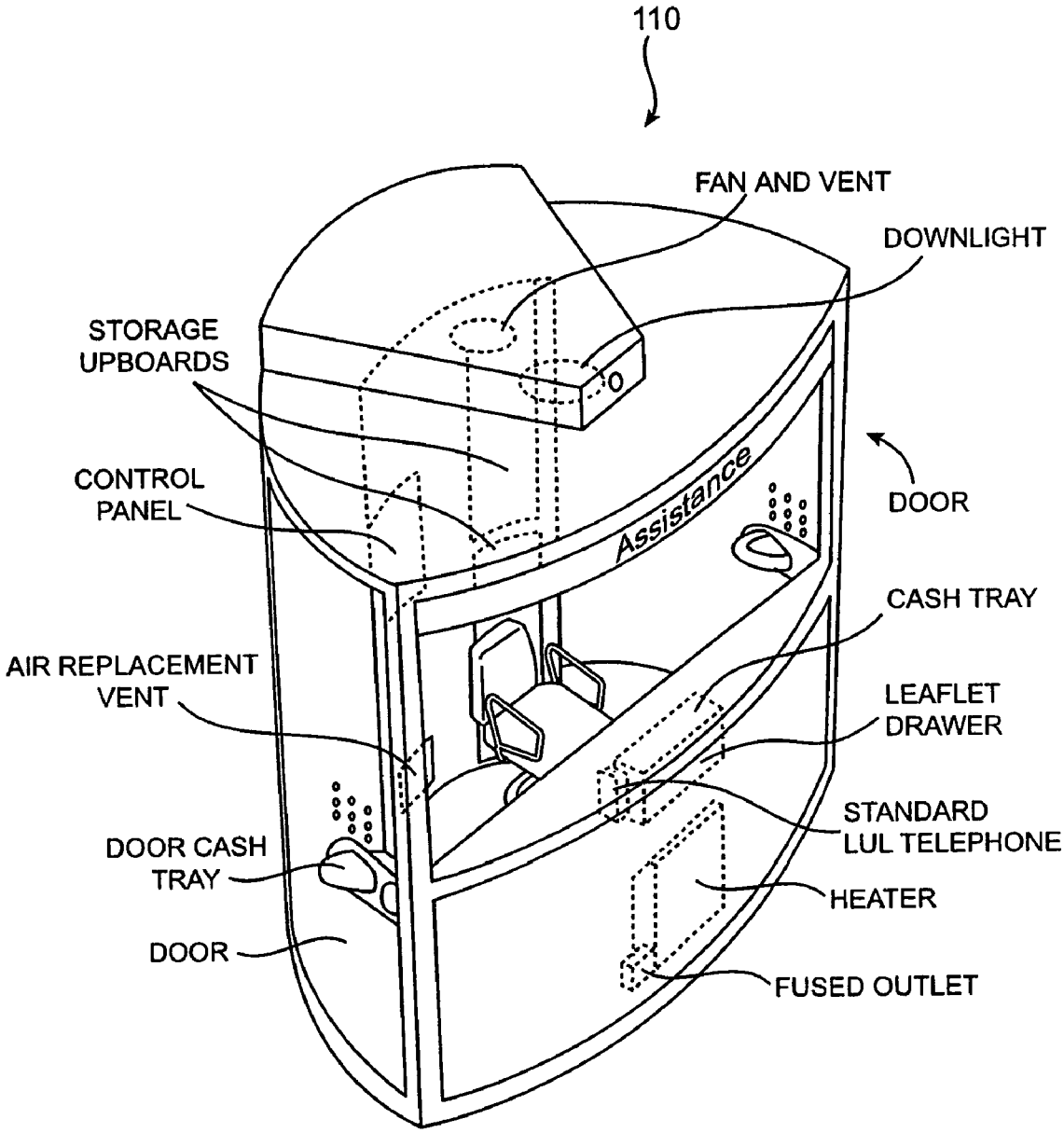
FIG. 11 is an illustration of a security kiosk design.

In one embodiment, as shown in FIG. 11, the virtual gate 2 with a sheriff or fare enforcement officer security desk or kiosk 30 adds to the gate security. The manned security desk or kiosk 30 helps to deter gate violators where there are multiple gates. The security desk or kiosk is placed in a location to view all the gates as shown in FIG. 9. FIG. 11 illustrates a Fare Enforcement Officer Kiosk 110 which may be located beyond the gates 2,4 to deal with patrons as required. These kiosks provide a more comfortable working environment and a place to store Hand Held Validators (HHV) to allow the enforcement officer to provide gate security.

The virtual gate and virtual gate system as disclosed herein provide many advantages over existing gate systems. The presently disclosed virtual gate provides a more customer accessible and user friendly fare collection system and the virtual gate may be used to replace existing stand alone validators. The virtual gate as disclosed herein also adds a level of security that deters fare evasion, and which is easily upgradeable to a full gate system by addition of a paddle, leaf or tripod barrier into the gate. The virtual gate may be oriented in any direction and facilitates both check-in systems and check-in/check out systems.

Although this disclosure has been shown and described with respect to detailed embodiments, those skilled in the art will understand that various changes in form and detail may be made without departing from the scope of the claimed disclosure.

What is claimed is:

1. A virtual gate, comprising:

a housing;

located in the housing is an access card reader;

an interface board for communicating with the access card reader;

a controller located within the housing and coupled to the interface board and configured to process card transaction information, and configured to receive configuration parameters and fare tables from a Central Data Collections System; and a visual indicator to indicate whether a transaction has been completed.

2. A virtual gate, comprising:

a housing:

located in the housing is an access card reader;

an interface board for communicating with the access card reader;

a controller located within the housing and coupled to the interface board and configured to process card transaction information;

a visual indicator to indicate whether a transaction has been completed; and a plurality of virtual gates arranged in a row to define a virtual barrier.

3. The virtual gate according to claim 2, wherein the visual indicator indicates a go or a no-go situation.

4. The virtual gate according to claim 3, further comprising a speaker connected to the interface board so that the speaker emits an audible tone.

5. The virtual gate according to claim 4, wherein the speaker is capable of emitting a first audible tone indicating a go situation and further is capable of emitting a second audible tone indicating a no-go situation.

6. The virtual gate according to claim 2, wherein the visual indicator is either an illumination of a green light to indicate a go situation or an illumination of a red light to indicate a no-go situation.

7. A virtual gate, comprising:

a housing;

located in the housing is an access card reader;

an interface board for communicating with the access card reader;

a controller located within the housing and coupled to the interface board and configured to process card transaction information;

a visual indicator to indicate whether a transaction has been completed; and a plurality of virtual gates arranged generally in a row and generally parallel in relation to each other to define a virtual barrier between a restricted area and a non-restricted area.

8. The virtual gate according to claim 7, wherein the virtual gates allow traffic to flow into and out of the restricted area.

9. The virtual gate according to claim 7, wherein the virtual gates are reversible to control traffic into and out of the restricted area.

10. The virtual gate according to claim 7, wherein the virtual gates are upgradeable so that physical gates may be added to each virtual gate.

11. The virtual gate according to claim 10, wherein the virtual gates include a motor located in the housing and the motor is connected to the interface board.

12. The virtual gate according to claim 7, wherein the plurality of virtual gates define a virtual gate system, and the virtual gate system further comprises indicia located along the alignment of the virtual gates to further define the virtual barrier.

13. A virtual gate system for controlling access to an area, comprising:

a plurality of virtual gates arranged generally in a row and generally parallel in relation to each other to define a virtual baffler between a restricted and a non-restricted area;

each virtual gate comprising:

a housing;

located in the housing is an access card reader;

an interface board for communicating with the access card reader;

a controller located within the housing and coupled to the interface board and configured to process card transaction information; and a visual indicator to indicate whether a transaction has been completed.

14. The virtual gate system according to claim 13, wherein the visual indicator indicates a go or a no-go situation.

15. The virtual gate system according to claim 14, further comprising a speaker connected to the interface board so that the speaker emits an audible tone.

16. The virtual gate system according to claim 15, wherein the speaker is capable of emitting a first audible tone indicating a go situation and further is capable of emitting a second audible tone indicating a no-go situation.

17. The virtual gate system according to claim 13, wherein the visual indicator is either an illumination of a green light to indicate a go situation or an illumination of a red light to indicate a no-go situation.

18. The virtual gate system according to claim 13, wherein the virtual gates allow traffic to flow into and out of the restricted area.

19. The virtual gate system according to claim 13, wherein the virtual gates are reversible to control traffic into and out of the restricted area.

20. The virtual gate system according to claim 13, wherein the virtual gates are upgradeable so that physical gates may be added to each virtual gate.

21. The virtual gate system according to claim 20, wherein the virtual gates include a motor located in the housing and the motor is connected to the interface board.

22. The virtual gate system according to claim 13, wherein the plurality of virtual gates define a virtual gate system, and the virtual gate system further comprises indicia located along the alignment of the virtual gates to further define the virtual barrier.

* * * * *